US006997072B2

(12) United States Patent
Saito et al.

(10) Patent No.: US 6,997,072 B2
(45) Date of Patent: Feb. 14, 2006

(54) STARTING APPARATUS

(75) Inventors: Tatsuya Saito, Chiryu (JP); Masahiro Katoh, Chiryu (JP)

(73) Assignee: Denso Corporation, Kariya (JP)

( * ) Notice: Subject to any disclaimer, the term of this patent is extended or adjusted under 35 U.S.C. 154(b) by 45 days.

(21) Appl. No.: 10/780,769

(22) Filed: Feb. 19, 2004

(65) Prior Publication Data

US 2004/0231442 A1 Nov. 25, 2004

(30) Foreign Application Priority Data

Feb. 19, 2003 (JP) ..... 2003-041295

(51) Int. Cl.
*F02N 11/00* (2006.01)

(52) U.S. Cl. ..... 74/7 E; 74/7 C; 123/179.25; 123/198 E

(58) Field of Classification Search ..... 74/6, 74/7 E, 7 C; 123/179.25, 198 E
See application file for complete search history.

(56) References Cited

U.S. PATENT DOCUMENTS 4,503,719 A * 3/1985 Hamano ..... 74/7 E
4,680,979 A 7/1987 Morishita et al.
5,199,309 A 4/1993 Isozumi
5,323,663 A 6/1994 Ohgi et al.
5,905,309 A * 5/1999 Ohmi et al. ..... 74/7 E
5,905,310 A * 5/1999 Nagao ..... 74/7 E
6,664,652 B1 * 12/2003 Chane-Waye ..... 74/7 E
2002/0069711 A1 * 6/2002 Hosoya ..... 74/6
2003/0097891 A1 * 5/2003 Siems et al. ..... 74/6
2003/0200826 A1 10/2003 Oomura et al.

FOREIGN PATENT DOCUMENTS

EP 1 357 287 A 10/2003
FR 516919 4/1921

* cited by examiner

*Primary Examiner*—Erick Solis
(74) *Attorney, Agent, or Firm*—Oliff & Berridge, PLC

(57) ABSTRACT

A starting apparatus for starting an engine has a drive motor and a reduction gear. The reduction gear includes a shock absorbing member and restricting members. The shock absorbing member is provided to elastically receive a reaction force exerted to an internal gear. The restricting members are provided to restrict a compressed amount of the shock absorbing member by making contact with each other. When bringing into contact with each other, the restricting members make contact at the outside diameter portions thereof. Accordingly, unpleasant noise generated during the operation of the starting apparatus is reduced by the shock absorbing member. Further, the damage to respective parts is reduced.

7 Claims, 7 Drawing Sheets

STARTING APPARATUS

CROSS REFERENCE TO RELATED APPLICATION

This application is based on Japanese Patent Application No. 2003-41295 filed on Feb. 19, 2003, the disclosure of which is incorporated herein by reference.

FIELD OF THE INVENTION

The present invention relates to a starting apparatus used to start an engine. More particularly, the present invention relates to a starting apparatus having a reduction gear with a planetary gear.

BACKGROUND OF THE INVENTION

An internal combustion engine (hereinafter, simply referred to as "engine") needs to be started by using a starting apparatus (hereinafter, pertinently referred to as "starter"). As the starting apparatus, there are a gear type starter and the like all of which are common in that an electric motor (hereinafter, simply referred to as "motor") constitutes a drive source.

In starting the engine, comparatively large torque is required although depending on a kind and a displacement thereof. Therefore, when the engine is cranked directly by the motor, the physical configuration of the motor naturally becomes large. Hence, in a recent starting apparatus requesting light-weighted compact formation, high torque necessary for starting is achieved by interposing a reduction gear between the motor and the engine to thereby increase a speed reducing ratio.

Although there are various reduction gears, a reduction gear of a planetary gear type, which compactly achieves a large speed reducing ratio, is frequently used. In the planetary-type reduction gear, a driving force inputted from the motor to a sun gear of the reduction gear is outputted from a carrier supporting a planetary gear with high torque. As premise thereof, a large reaction force (torque) produced in accordance with the output needs to be received by an internal gear. That is, rotation of the internal gear in the circumferential direction needs to be restricted.

Meanwhile, in the engine, torque necessary for rotating the engine is rapidly varied by strokes of intake, compression and the like and an engine rotation speed is also pulsated. The motor of the starter cannot well follow such a load variation or the like and therefore, the reaction force applied to the internal gear is not constant. As a result, unpleasant sound is likely to be generated in starting the engine due to vibration or the like of the internal gear by simply constraining the internal gear.

Hence, in order to alleviate and absorb the load variation or the like operated to the internal gear or the like, a shock absorbing member having an elastic body of rubber or the like is arranged between the internal gear and a portion of constraining the internal gear. This is for example proposed in unexamined Japanese Patent Publication No. JP-A-5-52166.

According to the starter disclosed in JP-A-5-52166, a projection, which extends from a side face of the internal gear in the axial direction, is held by a shock absorbing member (elastic body). Therefore, the starter is not enlarged in a radially outside direction. In this case, however, a friction plate is biased toward a pivoting plate engaging with the internal gear and the internal gear is constricted by friction force produced between them. Therefore, the structure of the starting apparatus is complicated. Further, the internal gear is not provided with a detent and therefore, the internal gear continues rotation little by little while the exerted reaction force is large. Therefore, an efficiency of transmitting drive force of the motor is likely to be reduced. If the detent is simply provided to the internal gear, a large reaction force is applied to the detent member. This may cause damage to the periphery of the detent.

SUMMARY OF THE INVENTION

The present invention is made in view of such a situation and it is an object of the present invention to provide a highly reliable, comparatively simple and efficient starting apparatus capable of resolving unpleasant sound or the like in starting.

According to the present invention, a starting apparatus has a drive motor and a reduction gear. The reduction gear has a sun gear, an internal gear, a planetary gear, a carrier and a rotation restricting unit. The sun gear is rotated by receiving an input from the drive motor. The internal gear is arranged concentrically with the sun gear on an outer peripheral side of the sun gear. The planetary gear meshes with the sun gear and the internal gear. The carrier rotatably supports the planetary gear and outputs the input of the sun gear by reducing a speed thereof. The rotation restricting unit for restricting rotation of the internal gear is arranged in a state of being movable in a circumferential direction. The drive motor rotates to start an engine via the reduction gear.

Further, the rotation restricting unit includes a movable locking portion, a movable contact portion, an unmovable locking portion, an unmovable contact portion and a shock absorbing member. The movable locking portion is provided at the internal gear and integrally rotates with the internal gear. The movable contact portion is arranged at a predetermined interval from the movable locking portion. The movable contact portion integrally rotates with the movable locking portion. The unmovable locking portion is opposed to the movable locking portion and faces the movable locking portion in the circumferential direction. Also, the unmovable locking portion is arranged in a state of being unmovable in the circumferential direction. The unmovable contact portion extends in an axial direction by being opposed to the movable contact portion and faces the movable contact portion in the circumferential direction. Also, the unmovable contact portion is arranged in a state of being unmovable in the circumferential direction. The shock absorbing member is in a shape of an elastic block. The shock absorbing member is elastically held at least between the movable locking portion and the unmovable locking portion for elastically receiving a reaction operated to the internal gear when the drive motor rotates to start the engine via the reduction gear. Further, a compressed amount of the shock absorbing member compressed between the movable locking portion and the unmovable locking portion is restricted by bringing the movable contact portion and the unmovable contact portion into contact with each other. In addition, the movable locking portion and the unmovable locking portion are disposed to make contact with each other at least at the outside diameter portions thereof first.

Accordingly, the internal gear is restricted from rotating at least in one direction by the rotation restricting means. In starting the engine by the starting apparatus, the internal gear receives reaction force (torque in opposed direction) in a direction opposite to an output of the carrier. The reaction force is received by the unmovable locking portion from the movable locking portion via the shock absorbing member. Thus, the internal gear is restricted from rotating in the direction of the reaction force. Here, the reaction force exerted to the internal gear is received by the unmovable locking portion elastically mildly by presence of the shock absorbing member. Therefore, shock load applied to the respective portions is reduced. Also, unpleasant sound, which is caused by direct contact of the locking portions, will be reduced. Further, the shock absorbing member also functions as a vibration isolating member and therefore, can absorb vibration or sound generated at the reduction gear or a surrounding thereof.

Further, even when the large reaction force is exerted to the internal gear, the rotation of the internal gear is restricted by bringing the movable contact portion into contact with the unmovable contact portion. Because the movable contact portion and the unmovable contact portion function as detent, rotation of the internal gear is restricted and therefore, an input from the drive motor is outputted from the carrier efficiently by reducing speed thereof. Further, the movable contact portion and the unmovable contact portion are disposed to make contact at the outside diameter portions thereof first. Therefore, the reaction force received between the movable contact portion and the unmovable contact portion is received at the position further from a rotation center axis. That is, the force applied at the contact portions is reduced. Therefore, it is less likely to cause cracks and the like to the movable contact portion and the unmovable contact portion, thereby increasing reliability of the starting apparatus.

In this way, the reduction gear of the invention can sufficiently reduce vibration, unpleasant sound or the like generated in operating the starting apparatus although the reduction gear is provided with a comparatively simple structure.

BRIEF DESCRIPTION OF THE DRAWINGS

Other objects, features and advantages of the present invention will become more apparent from the following detailed description made with reference to the accompanying drawings, in which like parts are designated by like reference numbers and in which:

FIGS. 7A and 7B are planarly developing views showing operation of the rotation restricting unit, in which FIG. 7A shows a state before operation of the starting apparatus and FIG. 7B shows a state during the operation of the starting apparatus.

DETAILED DESCRIPTION OF EMBODIMENTS

Embodiments of the present invention will be described hereinafter with reference to the drawings.

[First Embodiment]

Figure 1:
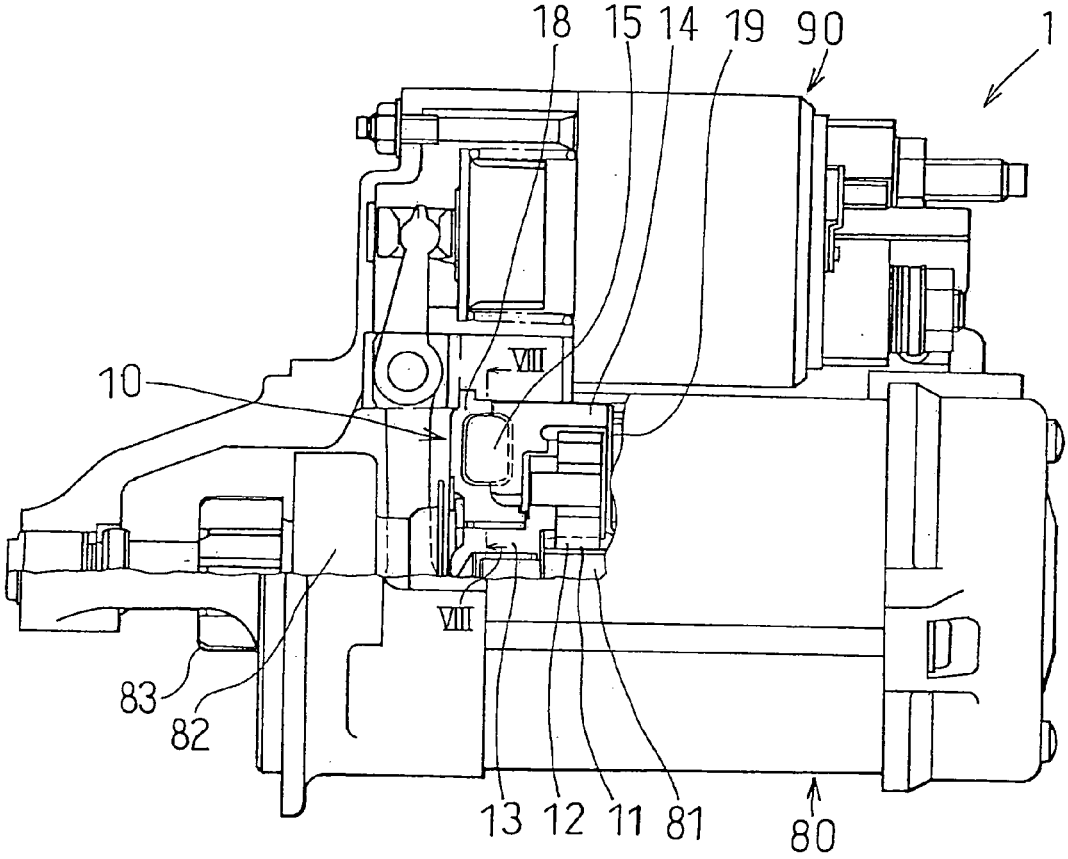
FIG. 1 is a general view of a starting apparatus, partly including a cross-section, according to a first embodiment of the present invention.

Referring to FIG. 1, a starting apparatus of the first embodiment of the present invention is for example employed to a gear type starter (hereinafter, simply referred to as "starter") 1. The starter 1 mainly includes a reduction gear 10, a motor 80 and a magnet switch 90. An output of the motor 80 is transmitted from a carrier 13 to an output shaft formed with a helical spline at an outer peripheral face thereof, through the reduction gear 10. An overrunning clutch (one way clutch) 82 and a pinion gear 83 are arranged on the helical spline. In starting, the overrunning clutch 82 and the pinion gear 83 are pushed in an axially forward direction (to a left side of FIG. 1) by lever operation of the magnet switch 90. Further, the pinion gear 83 is temporarily brought in mesh with a ring gear attached to a crankshaft of the engine, to thereby crank the engine. When the engine has been started, the pinion gear 83 of the starter 1 is idly rotated by the overrunning clutch 82, to thereby restrict excessive rotation of the motor 80.

Meanwhile, the reduction gear 10 is constructed of a sun gear 11, three planetary gears 12, the carrier 13, a cylindrical resin member 14, a containing case (case) 18, and shock absorbing members 15. The sun gear 11 is formed at a motor main shaft 81 extending from the motor 80. The three planetary gears 12 are arranged at the periphery of the sun gear 11. The planetary gears 12 mesh with the sun gear 11. The carrier 13 rotatably and revolvably supports the planetary gears 12. The cylindrical resin member 14 is arranged on the outer periphery of the planetary gears 12. The cylindrical resin member 14 is formed with an internal gear 149 on a cylindrical inner face thereof, to mesh with the planetary gears 12. The containing case 18 is arranged on an axially front side (left side of FIG. 1) of the cylindrical resin member 14. The shock absorbing members 15 are interposed between the cylindrical resin member 14 and the containing case 18. A cover plate 19 is provided on an axially rear face of the cylindrical resin member 19. The cover plate 19 closes a front opening of a housing of the motor 80 and restricts an axially rearward movement of the cylindrical resin member 14.

The cylindrical resin member 14, the shock absorbing member 15 and the case 18 construct a rotation restricting unit. The rotation restricting unit is a feature of the embodiment and will be described in detail hereafter.

Figure 2:
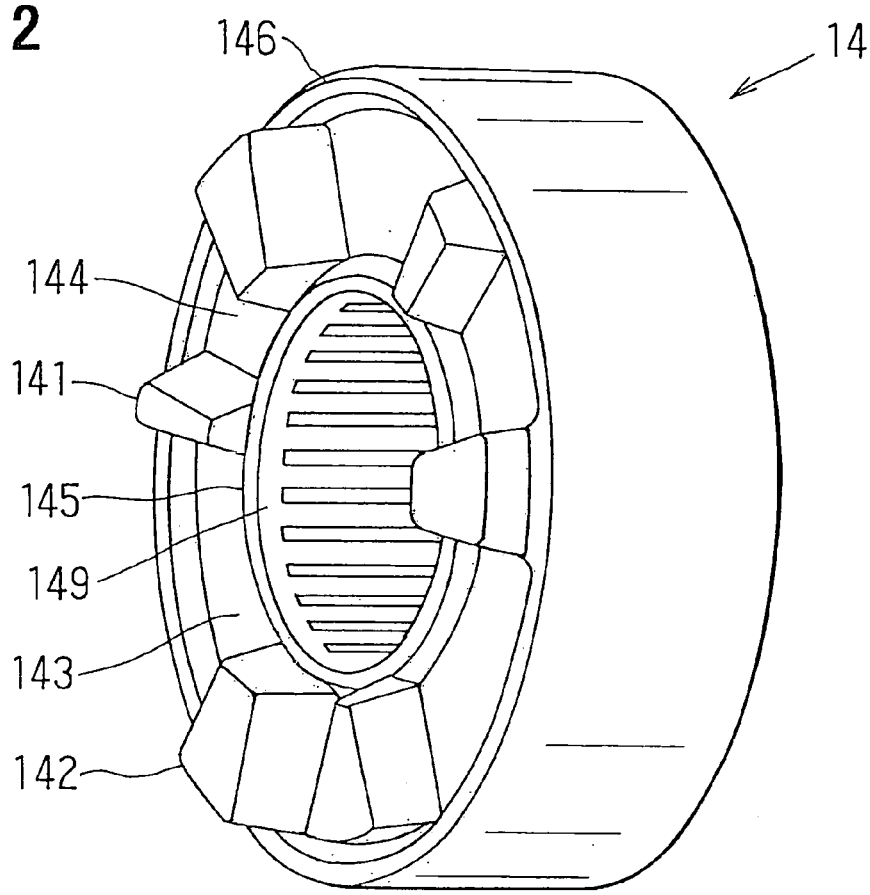
FIG. 2 is a perspective view of a cylindrical resin member of the starting apparatus according to the first embodiment of the present invention.

As shown in FIG. 2, the cylindrical resin member 14 is substantially in a shape of a bottomed cylinder and is integrally molded by thermoplastic resin. The cylindrical resin member 14 is arranged such that an annular bottom wall is located on a front side (left side in FIG. 2) and the cylindrical wall portion is located on a rear side (right side in FIG. 2). The internal gear 149 is integrally molded on the cylindrical inner face of the cylindrical wall portion. The annular bottom wall of the cylindrical resin member 14 is formed with three pairs of movable locking projections 141 and movable contact projections 142. The movable locking projections 141 and the movable contact projections 142 are radially formed at regular intervals in a circumferential direction and project in the axially forward direction. A wall thickness of the movable contact projection 142 is greater than a wall thickness of the movable locking projection 141 to be able to stably receive large reaction force. A specific shape of the movable contact projection 142 will be described later in detail.

Further, the cylindrical resin member 14 is provided with an inner ring-like projection 145 and an outer ring-like projection 146. The inner ring-like projection 145 is formed along an inner peripheral end of the bottom wall and slightly projects in the axially forward direction. The outer ring-like projection 146 is formed along an outer peripheral end of the bottom wall and slightly projects in the axially forward direction. On the bottom wall of the cylindrical resin member 14, main movable recessed portions 143 and sub movable recessed portions 144, which are slightly recessed, are alternately formed by the inner ring-like projection 145, the outer ring-like projection 146, the movable locking projections 141, and the movable contact projections 142. Further, a ratio of circumferential lengths of the main movable recessed portion 143 and the sub movable recessed portion 144 can be easily adjusted by changing a position of the movable locking projection 141 between the adjacent two movable contact projections 142.

Figure 3:
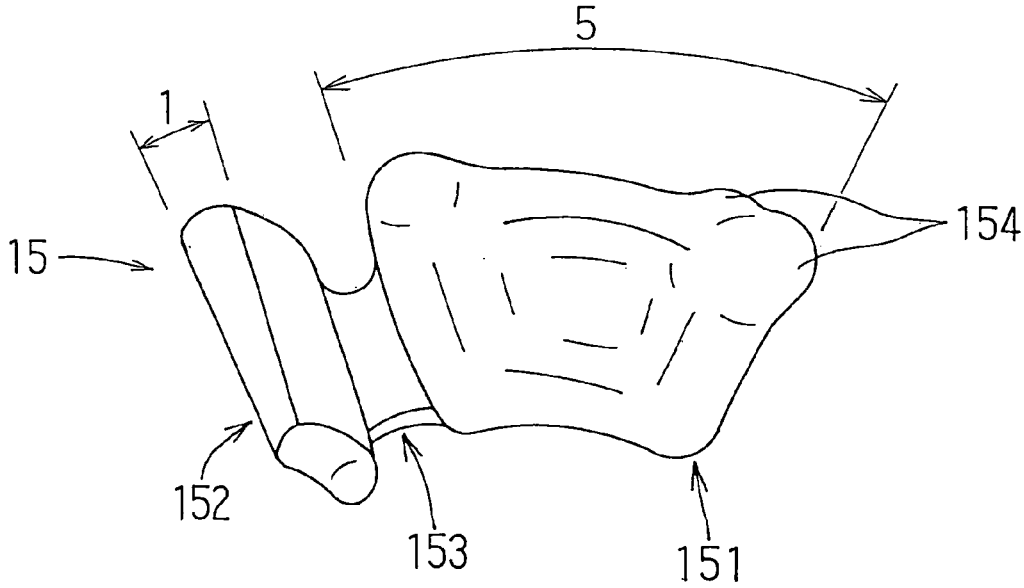
FIG. 3 is a plan view of a shock absorbing member of the starting apparatus according to the first embodiment of the present invention.

As shown in FIG. 3, each of the shock absorbing members 15 has a main elastic block portion 151, a sub elastic block portion 152 and a bridging portion 153 bridging between the main elastic block portion 151 and the sub elastic block portion 152. The shock absorbing member 15 is integrally molded by an oil resistant synthetic resin (NBR or the like). The shock absorbing member 15 is made of the oil resistant synthetic resin because the rubber will not deteriorated even when grease used for reducing abrasive resistance or the like is adhered to the rubber. By this, the function of the shock absorbing member 15 will last for a long period of time.

The main elastic block portion 151 is in the form of a fan-shaped block and a periphery of substantially a central portion thereof is constricted. Further, on the outer peripheral end of the main elastic block portion 151 that makes contact with the case 18, semispherical elastic projections 154 are formed on both its front face and its rear face. The sub elastic block portion 152 is in the form of a fan-shaped block. A circumferential length of the sub elastic block portion 152 is considerably shorter than that of the main elastic block portion 151. In the embodiment, the circumferential ratio of the main elastic block portion 151 to the sub elastic block portion 152 is about 5 to 1. The bridging portion 153 connects an inner end of the main elastic block portion 151 and an inner end of the sub elastic block portion 152 in a form of belt.

Figure 4:
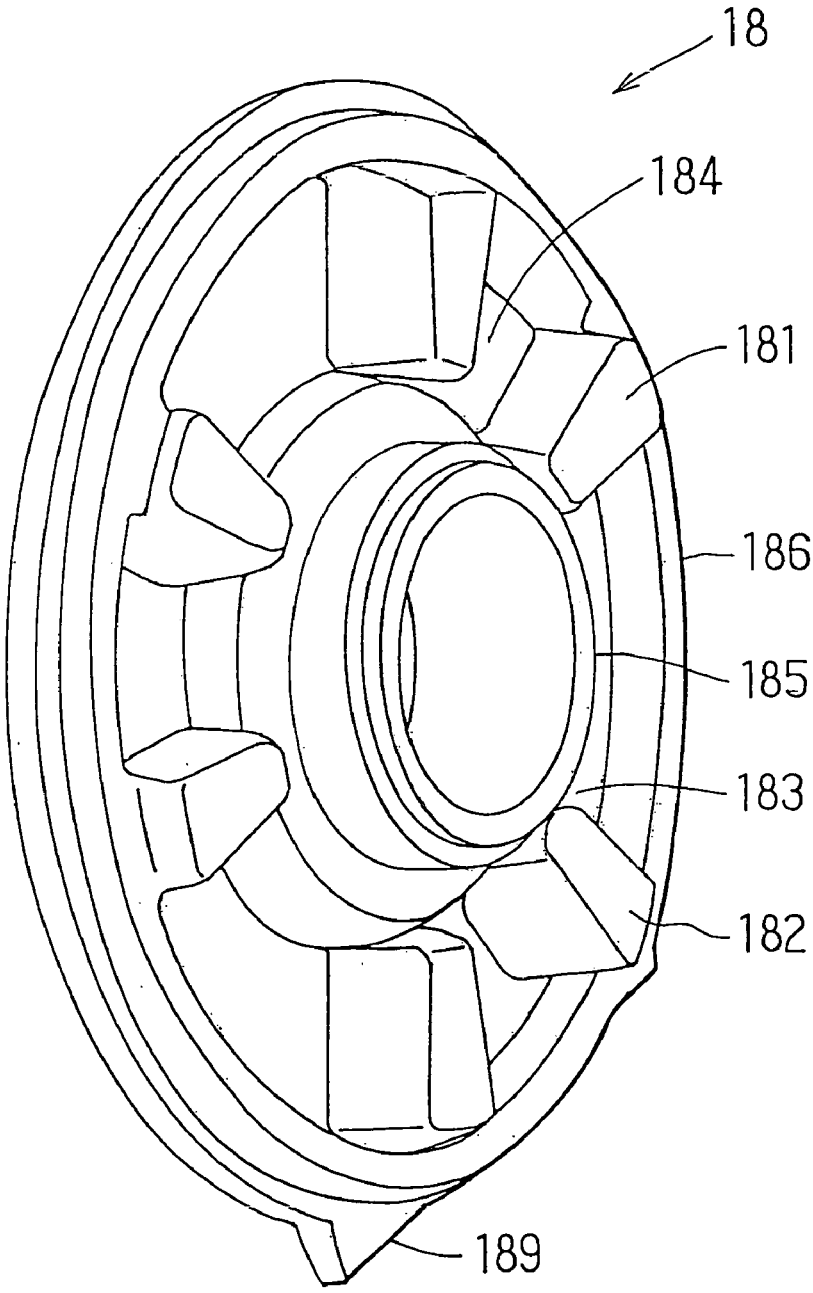
FIG. 4 is a perspective view of a containing case of the starting apparatus according to the first embodiment of the present invention.

As shown in FIG. 4, the case 18 is substantially in a form of a disk and formed by pertinently machining an aluminum alloy cast product. A front side (left side in FIG. 4) of the case 18 is formed substantially in a shape of a planar plate. Three pairs of unmovable locking projections 181 and unmovable contact projections 182 are formed on a rear face (right side in FIG. 4) of the case 18. The three pairs of the unmovable locking projections 181 and unmovable contact projections 182 are arranged radially at regular intervals. The unmovable locking projections 181 and the unmovable contact projections 182 project in the axially rearward direction. A wall thickness of the unmovable contact projection 182 is greater than a wall thickness of the unmovable locking projection 181 to stably receive large reaction force. A specific shape of the unmovable contact projection 182 will be described later in detail.

Further, the case 18 is formed with an inner ring-like projection 185 and an outer ring-like projection 186. The inner ring-like projection projects from an inner peripheral end of the case 18 in the axially rearward direction. The outer ring-like projection projects from an outer peripheral end of the case 18 in the axially rearward direction. Main unmovable recessed portions 183 and sub unmovable recessed portions 184, which are recessed, are formed by the inner ring-like projection 185, the outer ring-like projection 186, the unmovable locking projections 181, and the unmovable contact projections 182 alternately in the circumferential direction. Further, a ratio of circumferential lengths of the main unmovable recessed portion 183 to the sub unmovable recessed portion 184 can be easily adjusted by changing the position of the unmovable locking projection 181 between the adjacent two unmovable contact projections 182.

Further, the case 18 is provided with a locking piece 189 on its outer peripheral portion. The locking piece 189 is engaged with a housing of the starter 1 (not illustrated) to prevent the case 18 from rotating in the circumferential direction.

Figure 5:
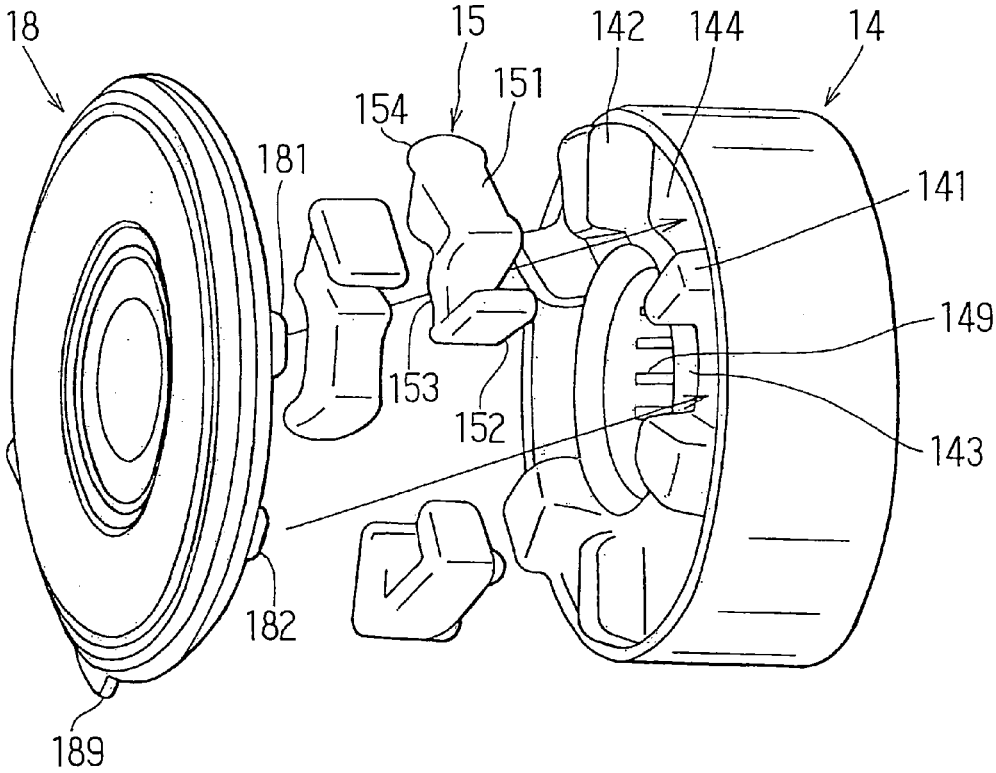
FIG. 5 is an exploded view of a rotation restricting unit according to the first embodiment of the present invention.
Figure 6:
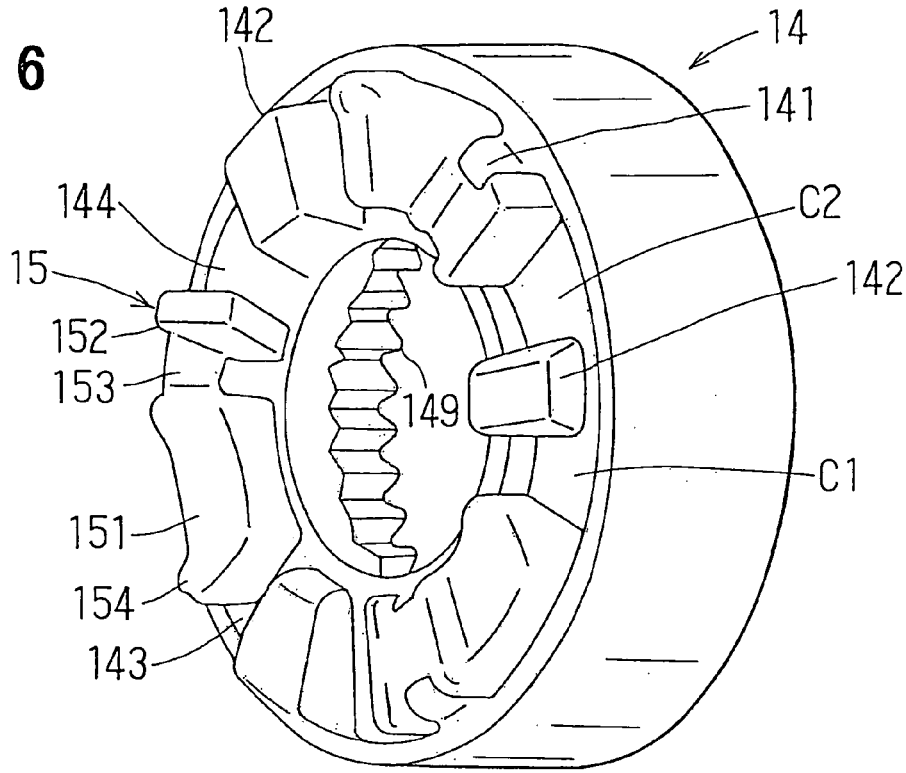
FIG. 6 is a perspective view of the cylindrical resin member on which the shock absorbing member is mounted according to the first embodiment of the present invention.

Next, assembling of the cylindrical resin member 14, the shock absorbing member 15 and the case 18 will be described with reference to FIGS. 5 and 6. FIG. 5 shows an exploded view of the three members. FIG. 6 shows the cylindrical resin member 14 on which the shock absorbing members 15 are mounted for convenience of explanation. In fact, the shock absorbing members 15 are mounted to the containing case 18 first, then the cylindrical resin member 14 is integrated thereto. An explanation will be given as follows in view thereof.

First, the shock absorbing members 15 are fixed to the case 18. At this time, each of the shock absorbing members 15 is fitted between the unmovable locking projection 181 and the unmovable contact projection 182 of the case 18. Then, the cylindrical resin member 14 is joined with the case 18 such that the movable locking projection 141 of the cylindrical resin member 14 is inserted between the main elastic block portion 151 and the sub elastic block portion 152 of the shock absorbing member 15. Therefore, elastic block portion 151 and the sub elastic block portion 152 elastically interpose the movable locking projection 141 between them. This fixing step of the cylindrical resin member 14 to the shock absorbing member 15 is performed at the respective three locations in the circumferential direction. By this, the unmovable locking projections 181 are generally interposed between the movable contact projections 142 of the cylindrical resin member 14 and the main elastic block portions 151 of the shock absorbing member 15. Further, the sub elastic block portion 152 of the shock absorbing member 15 is elastically interposed between the unmovable contact portion 182 and the movable locking projection 141.

In a condition that the cylindrical resin member 14 and the case 18 are joined, the inner ring-like projection 145 and the outer ring-like projection 146 of the cylindrical resin member 14 are respectively opposed to the inner ring-like projection 185 and the outer ring-like projection 186 of the containing case 18. Therefore, a hermetically sealed inner space are formed between the cylindrical resin member 14 and the containing case 18. The shock absorbing members 15 are contained in the inner space. Also, the cylindrical resin member 14 is elastically supported in the axial direction, that is, in a thrust direction relative to the case 18 by the elastic projections 154 provided on both the front face and the rear face of the main elastic block portions 151 of the shock absorbing member 15. The elastic projection 154 is formed in the semispherical shape and makes point contact with the wall face. Therefore, pivoting of the cylindrical resin member 14 relative to the case 18 is less likely to be hampered. Accordingly, wear, deterioration or the like of the elastic projection 154 is reduced. Further, since the cylindrical resin member 14 is supported by the elastic projections 154 at the three locations disposed at regular intervals in the circumferential direction, the cylindrical resin member 14 maintains a very stable position. Therefore, transmission loss of the drive force of the internal gear 149 caused by an inclination or the like thereof, wear or the like thereof can be reduced.

Figure 7A:
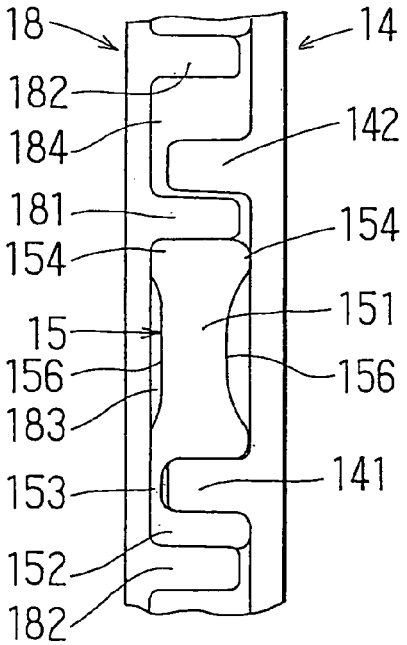
Figure 7B:
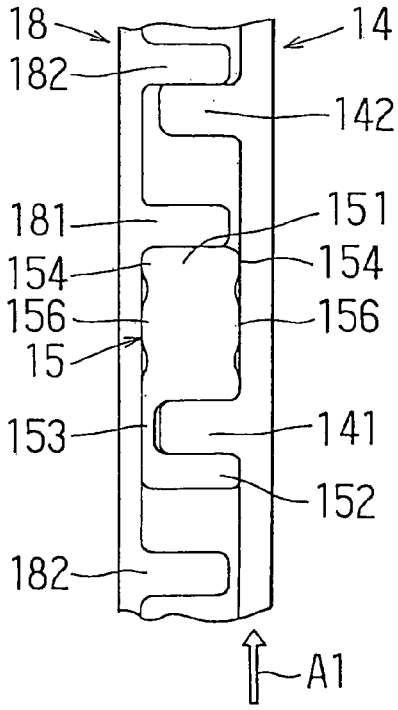

Next, an operation of the rotation restricting unit will be described with reference to FIGS. 7A and 7B. FIG. 7A shows the rotation restricting unit before starting the engine. FIG. 7B shows the rotation restricting unit after starting the engine.

As shown in FIG. 7A, before the starting operation of the starter 1, the shock absorbing member 15 is fitted in the main unmovable recessed portion 183, specifically, in a space defined by the unmovable locking projection 181, the unmovable contact projection 182 and the movable locking projection 141 in a condition being elastically compressed (pre-compression). Further, the movable contact projection 142 is loosely fitted in the sub unmovable recessed portion 184, that is, in a space defined by the unmovable locking projection 181 and another unmovable contact projection 182 that is adjacent to the unmovable locking projection 181 in the circumferential direction. Before operating the starter 1, the shock absorbing member 15 is not substantially compressed except a pre-compression amount that is caused in mounting the shock absorbing member 15 to the case 18. Also, the movable contact projection 142 is located at a position separate from the unmovable contact projection 182, that is, located on a side of the unmovable locking projection 181.

On the other hand, when the starter S starts operation, the cylindrical resin member 14 receives the reaction force from the internal gear 149 in a direction denoted by an arrow A1 (upward in FIG. 7B). By the reaction force, the movable locking projection 141 compresses the main elastic block portion 151 in the direction A1 of the reaction force. In the embodiment, before starting the starter 1, the movable locking projection 141 and the main elastic block portion 151 are elastically in close contact with each other. Therefore, the reaction force operated to the cylindrical resin member 14 is mildly absorbed from the start by the main elastic block portion 151 through the movable locking projection 141. Accordingly, it is less likely that shock load will be rapidly exerted thereto. Further, in the compressing operation, the main unmovable recessed portion 183 achieves a function of a guide groove. The shock absorbing member 15 and the movable locking projection 141 are respectively guided thereby. Furthermore, the sub unmovable recessed portion 184 achieves a function of a guide groove. The movable contact projection 142 is guided in the sub unmovable recessed portion 184.

When the reaction force is further increased and the compressed amount of the main elastic block portion 151 by the movable locking projection 141 reaches a vicinity of a limit (for example, compressed amount of 30%), the movable contact projection 142, which moves integrally with the movable locking projection 141, is brought into contact with the unmovable contact projection 182 of the case 18, which is fixed, as shown in FIG. 7B. Thereafter, the rotation of the cylindrical resin member 14 in the direction A1 of the reaction force is restricted. By the contact of the movable contact projection 142 and the unmovable contact projection 182, the compressed amount of the main elastic block portion 151 is prevented from exceeding the limit compressed amount (maximum compressed amount).

Further, when the reaction force exerted to the cylindrical resin member 14 is released after starting the engine or the like, the shock absorbing member 15 and the cylindrical resin member 14 return from the state shown in FIG. 7B to the state shown in FIG. 7A. At this time, the movable locking projection 141 is reversely rotated, that is, returns toward another unmovable contact projection 182, which is located on a lower side of FIG. 7. Inherently, the returning force is small and the sub elastic block portion 152 exists between the movable locking projection 141 and the unmovable contact projection 182. At this time, therefore, shock load or the like is less likely to be applied to the respective portions and unpleasant sound or the like will not be caused at the surrounding.

Figure 8:
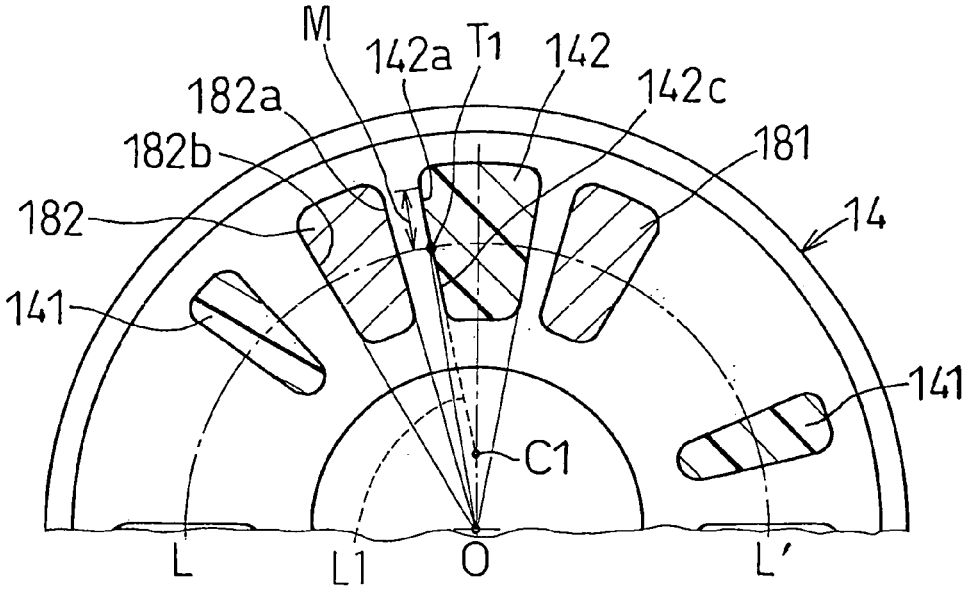
FIG. 8 is a semi-cross-sectional view of the rotation restricting unit taken along a line VIII—VIII in FIG. 1.

Next, the specific shape and positional relationship between the movable contact projection 142 and the unmovable contact projection 182 will de described with reference to FIG. 8. In FIG. 8, the shock absorbing members 15 are not illustrated for the convenience of explanation.

As shown in FIG. 8, the movable contact projection 142 and the unmovable contact projection 182 have substantially trapezoidal-shaped cross-sections. The movable contact portion 142 has side walls extending substantially in the radial direction. The unmovable contact portion 182 has side walls 182*a*, 182*b*, in form of substantially flat surfaces, extending substantially in the radial direction. The movable contact projection 142 and the unmovable contact projection 182 make contact with each other at the side walls 142*a*, 182*a* that are located radially outside of a centerline LL' (contact portion M in FIG. 8). The centerline LL' passes through middle positions of the movable contact projection 142 and the unmovable contact projection 182 in the radial direction. That is, the movable contact projection 142 and the unmovable contact projection 182 are formed such that outside diameter portions thereof are located in closer proximity to each other than their respective inside diameter portions.

More specifically, in the first embodiment, the side wall of the movable contact projection 142, which faces the side wall 182*a* of the unmovable contact portion 182, is formed of an outside diameter portion 142*a* and an inside diameter portion 142*c*. The outside diameter portion 142*a* is formed on a radial line from the center axis O. The inside diameter portion 142*c* is formed on a broken line L1 that passes through the point T1 on the central line LL' and a point C1. The point C1 is located radially outside from the center axis O. Therefore, the inner side wall 142*c* is recessed from the radial line on which the outer side wall 142*a* lies in the direction separate from the unmovable contact projection 182. In other wards, the outside diameter portion 142*a* leads the inside diameter portion 142*c* with respect to a radial line from the center axis O that passes through an inside diameter corner of the inside diameter portion 142*c* in its rotation direction.

Accordingly, when the movable contact projection 142 is brought into contact with the unmovable contact projection 182, the outside diameter portion 142*a* makes contact with the side wall 182*a* of the unmovable contact projection 182 first.

[Second Embodiment]

Figure 9:
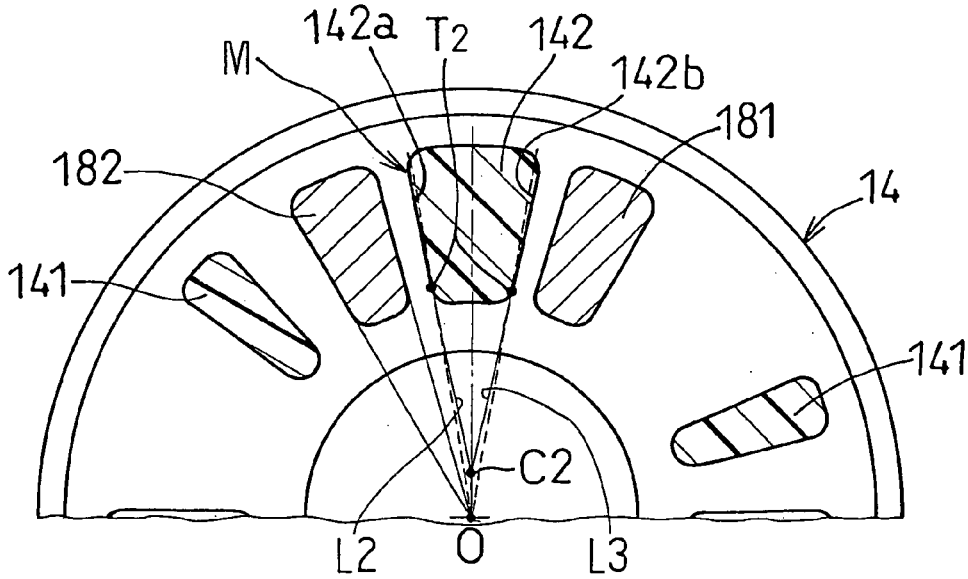
FIG. 9 is a semi-cross-sectional view of the rotation restricting unit according to a second embodiment of the present invention.

Next, the second embodiment of the present invention will be described with reference to FIG. 9. Also in the second embodiment, the movable contact projection 142 and the unmovable contact projection 182 make contact with each other at the radially outside portions thereof first. In the second embodiment, the movable contact projection 142 has the side walls 142*a*, 142*b*. The angle defined between the side walls 142*a*, 142*b* increases with the distance from the center axis O. Specifically, the side walls 142*a*, 142*b* are formed on lines L2, L3 that pass through the points T2 and the point C2. The point T2 is located on the radial line (dotted line in FIG. 9) from the center axis O that passes through the corner of the inside diameter portions of the movable contact projection 142. The point C2 is located radially outside from the center axis O.

Also in the second embodiment, the outside diameter portions of the movable contact projection 142 lead the inside diameter portions with respect to the radial lines from the center axis O that pass through the inside diameter portions in its rotation direction. Therefore, when the movable contact projection 142 is brought into contact with the unmovable contact projection 182, the movable contact projection 142 and the unmovable contact projection 182 make contact at the outside diameter portions thereof.

[Third Embodiment]

Figure 10:
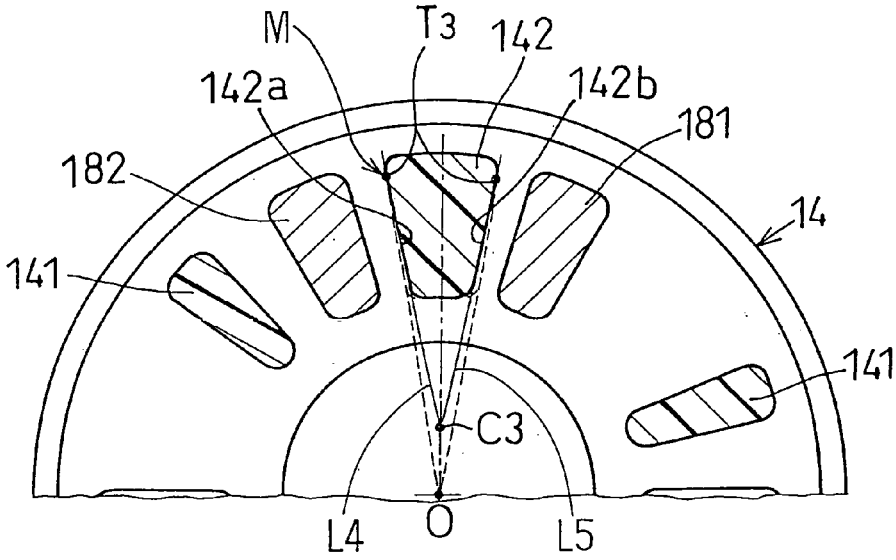
FIG. 10 is a semi-cross-sectional view of the rotation restricting unit according to a third embodiment of the present invention.

Next, the third embodiment of the present invention will be described with reference to FIG. 10. Also in the third embodiment, the angle defined between the side walls 142*a*, 142*b* of the movable contact projection 142 increases with the distance from the center axis O. Specifically, the side walls 142*a*, 142*b* are formed on lines L4, L5 that pass through the points T3 and the point C3. The point T3 is located on radial lines that connect the center axis O and the corner at the outside diameter portions of the movable contact portion 142. The point C3 is located radially outside from the center axis O.

Similar to the first and the second embodiments, the movable contact projection 142 and the unmovable contact projection 182 make contact with each other at the outside diameter portions thereof first.

In the first to the third embodiments, the side walls of the movable contact projection 142 are changed in various ways. Alternatively, the side walls of the unmovable contact projection 182 can be changed. The side walls 182*a*, 182*b* of the unmovable contact projection 182 may be formed in manners similar to the side walls 142*a*, 142*b*, 142*c* of the mocavle contact projection 142. Further, the above described side walls can be employed to both the movable contact projection 142 and the unmovable contact projection 182 in various combinations.

According to the starter 1 of the embodiments, the internal gear 149 is restricted from rotating at least in one direction by the rotation restricting unit constructed of the movable locking portion 141, the unmovable locking portion 181, the shock absorbing member 15, the movable contact portion 142 and the unmovable contact portion 182.

In starting the engine by the starter 1, the reaction force exerted to the internal gear 140 is received by the unmovable locking portion 181 through the movable locking portion 141 and the shock absorbing member 15. Thus, the internal gear 149 is restricted from rotating in the direction of the reaction force. The reaction force is received by the unmovable locking portion 181 elastically and gently by presence of the shock absorbing member 15. Therefore, shock load is not applied to the respective portions and unpleasant sound or the like will not be generated. Further, the shock absorbing member 15 functions as a vibration isolating member and therefore, can absorb vibration or sound generated at the reduction gear 10 or a surrounding thereof. In this way, the reduction gear 10 can reduce vibration, unpleasant sound or the like generated in operating the starter 1 although the reduction gear 10 is provided with a comparatively simple structure.

Even when the large reaction force is exerted to the internal gear 149, rotation of the internal gear 149 is restricted by bringing the movable contact portion 142 into contact with the unmovable contact portion 182. Therefore, a compressed amount of the shock absorbing member 15 is limited within a predetermined range. Thereby, destruction, damage, early fatigue or the like of the shock absorbing member 15 by an excessively large compressed amount can be restricted beforehand. Further, reliability of the shock absorbing member 15 and therefore, reliability of the starter 1 is improved. Further, the movable contact portion 142 and the unmovable contact portion 182 function as the detent, rotation of the internal gear 149 is restricted and therefore, an input from the drive motor 80 is outputted from the carrier 13 by reducing speed thereof.

Since the shock absorbing member 15 is elastically held between the movable locking portion 141 and the unmovable locking portion 181, load applied from the movable locking portion 141 to the shock absorbing member 15 is elastic and gradual from start of operating the starter 1. Further, when the shock absorbing member 15 returns after starting the engine, the movable locking portion 141 gradually receives the return force. A state in which the shock absorbing member 15 is elastically held between the movable locking portion 141 and the unmovable locking portion 181 is achieved by, for example, fixing the shock absorbing member 15 between the movable locking portion 141 and the unmovable locking portion 181 while compressing the shock absorbing member 15 by a small amount.

In this way, the highly reliable and highly efficient starter 1, which is capable of reducing unpleasant sound or the like, is provided. Further, a compressed amount allowed to the shock absorbing member (maximum compressed amount) 15 can easily be set to change by adjusting an interval between the movable contact portion 142 and the unmovable contact portion 182 and therefore, a degree of freedom of designing the reduction gear 10 is increased.

Further, the movable contact portion 142 and the unmovable contact portion 182, which provide the detent, are disposed to contact with each other at least at the outside diameter portions thereof first. Accordingly, the reaction force (rotational torque), which is received between the movable contact portion 142 and the unmovable contact portion 182, are received at the position that is farther from the center axis O. Therefore, the force exerted to the contact portions M is reduced. Because it is less likely to cause cracks on the movable contact portion 142 and the unmovable contact portion 182, the reliability of the starter 1 improves. Further, it is possible to increase the thickness of the movable contact portion 142 and the unmovable contact portion 182 at the outside diameter portions greater than the inside diameter portions. Therefore, the movable contact portion 142 and the unmovable contact portion 182 are easily reinforced. Even if casts having large tolerances and volume products are used, the movable contact portion 142 and the unmovable contact portion 182 can make contact at the outside diameter portions. Therefore, it is less likely to cause cracks on the inside diameter portions of the movable contact portion 142 and the unmovable contact portion 182.

The side wall 142*a* of the movable contact portion 142, which is adjacent to and makes contact with the side wall 182*a* of the unmovable contact portion 182 slightly protrudes toward the unmovable contact portion 182 from the radial line passing through the inside diameter portion thereof. It is not always necessary that the side wall 142*a* is flat. The side wall 142*a* can be curved from the inside diameter portion to the outside diameter portion. The side wall 182*a* of the unmovable contact portion 182 can be formed such that the outside diameter portion thereof protrudes more than the inside diameter portion thereof with respect to a radial line from the center axis O that passes through the inside diameter portion. Also, the opposite side wall 182*b* of the unmovable contact portion 182 can be formed similar to the side wall 182*a*. Since it is not limited to the rotational direction of the starter 1, this arrangement improves general versatility of the parts. The movable contact portion 142 and the unmovable contact projection 182 are disposed to make contact with each other at least at the outside diameter portions first. Thereafter, the contact projections 142, 182 can make contact at the middle portions and then at the inside diameter portions. That is, the portions 142, 182 can make surface contact after the contact of the outside diameter portions thereof.

The shock absorbing member 15 can be provided by such as a spring, synthetic resin, synthetic rubber or the like. In a case that the shock absorbing member 15 is in the shape of the elastic block, it is preferable that the shock absorbing member 15 is made of synthetic rubber in view of function, reliability, cost, integration performance or the like. In this case further, it is preferable that the movable contact portion 142 and the unmovable contact portion 182 are arranged such that a maximum compression rate of the shock absorbing member 15 is in a range of 10% through 30%.

In general, an allowable maximum compression rate of synthetic rubber is normally set to be around 20% in consideration of durability thereof. However, since the shock absorbing member 15 is used in a short period of time in starting the engine as in the shock absorbing member 15, even in the case in which the compression rate exceeds 20%, the reliability is not deteriorated for a long period of time. However, if the compression rate exceeds 30%, it is not preferable because the shock absorbing member 15 may be destructed or damaged. Hence, in the embodiments, the compression rate is confined in 30%. Further, an upper limit of the compression rate can be easily restricted by the contact of the movable contact portion 142 and the unmovable contact portion 182. A lower limit of the compression rate is set to 10% for effectively utilizing elasticity of the shock absorbing member 15.

In order to gently absorb the reaction force exerted to the internal gear 149 by the shock absorbing member 15, it is necessary that the shock absorbing member 15 per se is easy to deform. Hence, the shock absorbing member 15 includes the main elastic block portion 151 having the main elastic block portion 151. The central portion with respect to the circumferential direction of the main elastic block portion 151 is constricted more slenderly than an end portion thereof. Also, the main elastic block portion 151 is compressible in the circumferential direction. Therefore, at least deformation resistance of the central portion is reduced. Further, when the shock absorbing member 15 is compressed, the constricted portion is expanded to the surrounding. Thus, the shape is changed in accordance with compression at the portion and therefore, elasticity of the shock absorbing member 15 is effectively utilized. In this way, by providing the constricted portion substantially at the center, the shock absorbing member 15 having large shock absorbing function is provided. Further, the shock absorbing member 15 is not constricted at the end portion and therefore, both the end portions of the shock absorbing member 15 are stably held by the movable locking portion 142 and the unmovable locking portion 182.

In fact, a direction of force operated to the movable locking portion 142 is changed before and after starting the engine. Therefore, the movable locking portion 142 and the internal gear 149 can be rotated in a direction opposite to the direction A1 of the reaction force. At this time, vibration or unpleasant sound may be generated by the reduction gear although an amount thereof is small. Hence, the shock absorbing member 15 further includes the sub elastic block portion 152 elastically held between the movable locking portion 141 and the unmovable contact portion 182 and the bridging portion 153 connecting between the main elastic block portion 151 and the sub elastic block portion 152 to span the movable locking portion 141. The ratio of the circumferential length of the main elastic block portion 151 to that of the sub elastic block portion 152 is preferably in a range of 4 through 6.

Thereby, the movable locking portion 141 is elastically held by the sub elastic block portion 152 on the side opposite to the main elastic block portion 151. As a result, the movable locking portion 141 and the internal gear 149 are elastically held in both the rotational directions. The movable locking portion 141 is held further stably. Therefore, unpleasant sound or the like generated by the reduction gear 10 can be reduced. Further, since the main elastic block portion 151 and the sub elastic block portion 152 are connected by the bridging portion 153 and therefore, integration or part control is facilitated.

Here, the ratio of the circumferential length of the main elastic block portion 151 to that of the sub elastic block portion 152 is in the range of 4 through 6 because the reaction force in starting, which is exerted in a direction of compressing the main elastic block portion 151, is larger than the opposite force exerted in a direction of compressing the sub elastic block portion 152. When the ratio of the circumferential length is less than 4, it is difficult to ensure durability of the main elastic block portion 151. On the other hand, when the ratio of the circumferential length is greater than 6, it is difficult to achieve compact formation. Further, the ratio of circumferential length may be compared by lengths of center circle arcs of the main elastic block portion 151 and the sub elastic block portion 152.

Although the shape, the number or the like of the shock absorbing member 15 is not particularly limited, it is preferable to arrange the shock absorbing members 15 respectively uniformly at three locations or more in the circumferential direction in order to achieve compact formation of the starter 1 and stable operation of the internal gear 149. Hence, three sets or more of the movable locking portions 141, the movable contact portions 142, the unmovable locking portions 181 and the unmovable contact portions 182 are respectively arranged at regular intervals in the circumferential direction. The shock absorbing members 15 are respectively arranged between the movable locking portions 141 and the unmovable locking portions 181.

Accordingly, inclination or deviation of the internal gear 149 in starting can be restricted and the starter 1 can be operated smoothly. Further, the reaction force in starting can be received by a plurality of the shock absorbing members 15 and therefore, the shock absorbing members 15 can be decreased in size and stable shock absorbing function can be achieved.

In the case of providing the shock absorbing members 15 at a plurality of locations, the shock absorbing members 15 can be integrated into a ring-like shape in view of part control, integration or the like. However, it is preferable to provide the shock absorbing members 15 separately. Because promotion of reliability of the shock absorbing members 15 is achieved by preventing dragging between the shock absorbing members 15 in accordance with compression of the main elastic block portion 151.

Although the movable locking portion 141 and the movable contact portion 142 are disposed to rotate with the internal gear 149, it is not always necessary that the movable locking portion 141 and the movable contact portion 142 are integrated into a single piece. For example, the internal gear 149, the movable locking portion 141, and the movable contact portion 142 are provided as the separate parts, and are joined to have a locking relationship so as to rotate integrally.

In the embodiments, the movable locking portion 141, the movable contact portion 142 and the internal gear 149 are integrally formed into the single part. Therefore, part control and assembly are facilitated. Even when the part has a complicated shape, the part can comparatively easily be provided at low cost by integral molding of resin. Hence, it is preferable that the movable locking portion 141, the movable contact portion 142, and the internal gear 149 are provided by the resin member having the substantially bottomed cylindrical shape, which is integrally molded by a resin. The internal gear 149 is inner teeth formed on an inner peripheral wall of the cylindrical portion of the cylindrical resin member 14. The movable locking portion 141 and the movable contact portion 142 project in the axially outward direction from the bottom face of the resin member.

In the embodiments, shock of reaction force or the like exerted to the internal gear 149 and the movable locking portion 141 can be absorbed by the shock absorbing member 15. Therefore, even when the members are integrally molded by resin, the members are not destructed or damaged and are excellent in wear resistance. Accordingly, reliability is improved.

Since the rotation of the unmovable locking portion 181 and the unmovable contact portion 182 is constricted, the unmovable locking portion 181 and the unmovable contact portion 182 are provided separately from the above resin member. The unmovable locking portion 181 and the unmovable contact portion 182 are formed in the case 18 to project from the bottom wall of the case in the axial direction. The unmovable locking portion 181 and the unmovable contact portion 182 are accommodated in the recessed portion formed in the cylindrical portion of the case 18.

Although an explanation has been given of a case in which the internal gear 149 is pivoted in the circumferential direction, in consideration of various vibrations applied to the internal gear 149, integration tolerance or the like, it is preferable that the internal gear 149 is elastically held also in the axial direction. Hence, the shock absorbing member 15 is provided with the elastic projected portions 154 extending in the axial direction. In this case, the elastic projected portions 154 are disposed on the side of the unmovable locking portion 181. Thus, the elastic projected portions 154 achieve a stable holding function. When the elastic projected portions 154 are formed on the side of the unmovable locking portion 181, the elastic projected portions 154 will less likely to be dragged with the rotation of the movable locking portion 141. Therefore, the elastic projected portions 154 achieve stable holding function in the axial direction. Further, since the elastic projected portion 154 has the semispherical shape, the elastic projected portion 154 makes a point contact with a sliding surface. Therefore, abrasion resistance is reduced and the internal gear 149 is smoothly pivoted. Further, since the sliding area is small, wear, damage or deterioration of the shock absorbing member 15 is reduced.

In this way, the starter 1 receives the reaction force in operating the starter by the shock absorbing member 15 while alleviating the reaction force. Therefore, damage or the like to the respective parts are reduced. The reliability of the starter 1 is improved.

In the specification, "unmovable" state referring to the unmovable locking portion or the unmovable contact portion, signifies that the portion is not substantially pivoted and more or less play or the like is not problematic thereby.

Further, the starter 1 of the invention is not limited to the gear type starter but may be other type of starter. Further, "circumferential direction" or "axial direction" in the specification is defined relative to the rotation center axis O of the reduction gear 10.

The present invention should not be limited to the disclosed embodiment, but may be implemented in other ways without departing from the spirit of the invention.

What is claimed is:

1. A starting apparatus for starting an engine comprising:

a drive motor generating a rotational force;

a reduction gear device including:

a sun gear disposed to rotate by receiving the rotational force from the drive motor;

an internal gear arranged concentrically with the sun gear on an outer periphery of the sun gear and rotatable in a circumferential direction;

a planetary gear meshing with the sun gear and the internal gear;

a carrier rotatably supporting the planetary gear and outputting the rotation of the sun gear by reducing a speed thereof; and a rotation restricting unit to restrict rotation of the internal gear, wherein the rotation restricting unit includes:

a movable locking portion provided to move with the internal gear in the circumferential direction;

a movable contact portion disposed at a predetermined distance from the movable locking portion in the circumferential direction and movable with the movable locking portion;

an unmovable locking portion held in a state unmovable in the circumferential direction and opposed to the movable locking portion in the circumferential direction;

an unmovable contact portion held in a state unmovable in the circumferential direction and opposed to the movable contact portion in the circumferential direction; and a shock absorbing member elastically held between the movable locking potion and the unmovable locking portion for elastically receiving a reaction force applied to the internal gear when the drive motor starts to rotate the engine via the reduction gear device, wherein a compression amount of the shock absorbing member is restricted by bringing the movable contact portion into contact with the unmovable contact portion, and wherein the movable contact portion and the unmovable contact portion are disposed such that the movable contact portion and the unmovable contact portion make contact at least at outside diameter portions thereof first when the movable contact portion is brought into contact with the unmovable contact portion.

2. The starting apparatus according to claim 1, wherein the movable contact portion has a first side wall and a second side wall opposite to each other in the circumferential direction, the first side wall facing the unmovable contact portion, the movable contact portion is disposed such that an outside diameter portion of the first side wall leads an inside diameter portion of the first side wall with respect to a radial line from a center axis of the rotation restricting unit in its rotation direction, the radial line passing through the inside diameter portion of the first side wall.

3. The starting apparatus according to claim 2, wherein the second side wall of the movable contact portion is disposed such that an outside diameter portion thereof leads an inside diameter portion thereof with respect to a radial line from the center axis of the rotation restricting unit in its rotation direction, the radial line passing through the inside diameter portion of the second side wall.

4. The starting apparatus according to claim 1, wherein the unmovable contact portion has a first side wall and a second side wall opposite to each other in the circumferential direction, the first side wall facing the movable contact portion, the first side wall is disposed such that an outside diameter portion thereof protrudes more than an inside diameter portion thereof with respect to a radial line from the center axis of the rotation restricting unit, the radial line passing through the inside diameter portion of the first side wall.

5. The starting apparatus according to claim 2, wherein the unmovable contact portion has a first side wall and a second side wall opposite to each other in the circumferential direction, the first side wall facing the movable contact portion, the first side wall of the unmovable contact portion is disposed such that an outside diameter portion thereof protrudes more than an inside diameter portion with respect to a radial line from the center axis of the rotation restricting unit, the radial line passing through the inside diameter portion of the first side wall of the unmovable contact portion.

6. The starting apparatus according to claim 1, wherein the movable contact portion and the unmovable contact portion are disposed such that outside diameter portions thereof are located in closer proximity to each other than their respective inside diameter portions.

7. The starting apparatus according to claim 6, wherein the rotation restricting unit further includes a cylindrical resin member and a case member opposed to each other in an axial direction, wherein the internal gear is provided on an inner wall of the cylindrical resin member, the movable contact portion and the movable locking portion are formed on the cylindrical resin member to protrude in the axial direction toward the case member, and the unmovable contact portion and the unmovable locking portion are formed on the case member to protrude in the axial direction toward the cylindrical resin member.

* * * * *